US007543346B2

(12) United States Patent
Roh et al.

(10) Patent No.: US 7,543,346 B2
(45) Date of Patent: Jun. 9, 2009

(54) DRUM WASHING MACHINE AND METHOD OF CONTROLLING THE SAME

(75) Inventors: Hyoung Hoon Roh, Suwon-si (KR); Seung Moo Lim, Suwon-si (KR); Chang Joo Chai, Suwon-si (KR); Yo Chul Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 724 days.

(21) Appl. No.: 11/107,752

(22) Filed: Apr. 18, 2005

(65) Prior Publication Data

US 2006/0112498 A1 Jun. 1, 2006

(30) Foreign Application Priority Data

Nov. 29, 2004 (KR) ..... 10-2004-0098905

(51) Int. Cl.
*D06F 33/02* (2006.01)

(52) U.S. Cl. ..... 8/159; 66/12.26

(58) Field of Classification Search ..... 68/12.02, 68/12.26; 134/184, 198
See application file for complete search history.

(56) References Cited

U.S. PATENT DOCUMENTS

| | | | | | |
|---|---|---|---|---|---|
| 2,960,046 | A | * | 11/1960 | Clark | 110/191 |
| 3,535,896 | A | | 10/1970 | Brown et al. | |
| 3,857,002 | A | * | 12/1974 | Lay et al. | 200/61.64 |
| 3,997,751 | A | * | 12/1976 | McNally | 200/61.62 |
| 5,172,577 | A | * | 12/1992 | Gibson | 70/272 |
| 5,655,394 | A | * | 8/1997 | DiRocco, Jr. | 70/159 |
| 6,036,241 | A | * | 3/2000 | Ostdiek et al. | 292/229 |
| 6,082,787 | A | * | 7/2000 | Chioffi et al. | 292/128 |
| 6,363,563 | B1 | | 4/2002 | Range et al. | |

(Continued)

FOREIGN PATENT DOCUMENTS

EP 0 381 022 A1 8/1990

(Continued)

OTHER PUBLICATIONS

EPO Examination Report, Nov. 5, 2007.

*Primary Examiner*—Frankie L Stinson
(74) *Attorney, Agent, or Firm*—Sughrue Mion, PLLC

(57) ABSTRACT

A drum washing machine and a method of controlling the same. The locked state of a door is released for a predetermined period of time without interrupting water supply or water drainage for a user to open the door, during supplying or draining of water, when a washing or dewatering operation of the drum washing machine is initiated or when the washing or dewatering operation of the drum washing machine is resumed after the washing or dewatering operation of the drum washing machine is interrupted. Consequently, additional laundry may be safely and conveniently put into a rotary tub or the laundry or foreign matter may be removed from the rotary tub with improved washing and dewatering efficiency. To this end, the drum washing machine includes a control unit for locking the door when the washing or dewatering operation is initiated, releasing the locked state of the door for a first predetermined period of time after the washing or dewatering operation is performed for a second predetermined period of time, and locking the door again after the first predetermined period of time elapses.

5 Claims, 6 Drawing Sheets

U.S. PATENT DOCUMENTS

| | | | | |
|---|---|---|---|---|
| 6,539,753 | B1 * | 4/2003 | Ito et al. | 68/3 R |
| 2005/0223506 | A1 * | 10/2005 | Kwen et al. | 8/159 |

FOREIGN PATENT DOCUMENTS

| | | | | |
|---|---|---|---|---|
| GB | 2 107 383 | A | | 4/1983 |
| JP | 9-201483 | A | | 8/1997 |
| JP | 2000-342881 | | * | 12/2000 |
| JP | 2001-162088 | | * | 6/2001 |

* cited by examiner

DRUM WASHING MACHINE AND METHOD OF CONTROLLING THE SAME

CROSS-REFERENCE TO RELATED APPLICATION

This application claims priority from Korean Patent Application No. 2004-98905, filed on Nov. 29, 2004 in the Korean Intellectual Property Office, the disclosure of which is incorporated herein by reference.

BACKGROUND OF THE INVENTION

1. Field of the Invention

The present invention relates to a drum washing machine and, more particularly, to a drum washing machine with a door-lock releasing function that is capable of releasing the locked state of a door of the drum washing machine for allowing additional laundry to be conveniently put into the drum washing machine without interrupting the operation of the drum washing machine. The present invention also relates to a method of controlling the same.

2. Description of the Related Art

Generally, a drum washing machine with a door-locking device is constructed such that the drum washing machine performs a washing operation after a door of the drum washing machine is locked by the door-locking device.

When a user opens the door of the drum washing machine, puts the laundry into a rotary tub, and presses a washing operation button, the door is locked by the door-locking device to prevent the door from opening during the washing operation, and thus, to prevent wash water from flowing out of the drum washing machine. After the door is locked by the door-locking device, wash water is supplied to the drum washing machine such that the washing operation is performed.

When the user presses an interruption button to put additional laundry into the rotary tub or remove the laundry from the rotary tub, the operation of the drum washing machine is interrupted. After that, the locked state of the door is released, and is then opened, which depends upon the water level in the rotary tub.

In the above-described conventional drum washing machine, the operation of the drum washing machine is interrupted, the water level in the rotary tub is checked, and then the door is opened for the user to put additional laundry into the rotary tub or remove the laundry from the rotary tub. As a result, washing efficiency is deteriorated, and putting additional laundry into the rotary tub is very inconvenient.

SUMMARY OF THE INVENTION

Therefore, it is an aspect of the invention to provide a drum washing machine that allows additional laundry to be conveniently put into the drum washing machine without interrupting the operation of the drum washing machine.

It is another aspect of the invention to provide a method of controlling a drum washing machine that is capable of conveniently putting additional laundry into the drum washing machine without interrupting the operation of the drum washing machine.

In accordance with one aspect, the present invention provides a method of controlling a drum washing machine with a door, comprising: locking the door when a washing or dewatering operation is initiated; releasing the locked state of the door for a first predetermined period of time after the washing or dewatering operation is performed for a second predetermined period of time; and locking the door again after the first predetermined period of time elapses.

The locked state of the door may be released after water is supplied or drained for the second predetermined period of time.

The first predetermined period of time may be a time for which the water level in a rotary tub is kept below a reference water level by supplying or draining water.

The locked state of the door may be released if it is sensed that the door has been opened during interruption of the washing or dewatering operation when the washing or dewatering operation is resumed after the washing or dewatering operation is interrupted.

The controlling method may further comprise: informing a user that the locked state of the door is released.

In accordance with another aspect, the present invention provides a method of controlling a drum washing machine with a door, comprising: locking the door when a washing operation is initiated; releasing the locked state of the door for a predetermined period of time after the washing operation is performed; and locking the door again after the predetermined period of time elapses.

In accordance with another aspect, the present invention provides a drum washing machine with a door, comprising: a control unit for locking the door when a washing or dewatering operation is initiated, releasing the locked state of the door for a first predetermined period of time after the washing or dewatering operation is performed for a second predetermined period of time, and locking the door again after the first predetermined period of time elapses.

The drum washing machine may further comprise: a door-locking device for locking or unlocking the door.

The drum washing machine may further comprise: an alarm unit for informing a user that the locked state of the door is released.

The control unit may release the locked state of the door after water is supplied or drained for the second predetermined period of time.

The first predetermined period of time may be a time for which the water level in a rotary tub is kept below a reference water level by supplying or draining water.

The control unit may release the locked state of the door if it is sensed that the door has been opened during interruption of the washing or dewatering operation when the washing or dewatering operation is resumed after the washing or dewatering operation is interrupted.

In accordance with yet another aspect, the present invention provides a drum washing machine with a door, comprising: a control unit for locking the door when a washing operation is initiated, releasing the locked state of the door for a predetermined period of time after the washing operation is performed, and locking the door again after the predetermined period of time elapses.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

DETAILED DESCRIPTION OF THE ILLUSTRATIVE, NON-LIMITING EMBODIMENTS OF THE INVENTION

Reference will now be made in detail to the illustrative, non-limiting embodiments of the present invention. An exemplary embodiment is described below to explain the present invention by referring to the figures.

Figure 1:
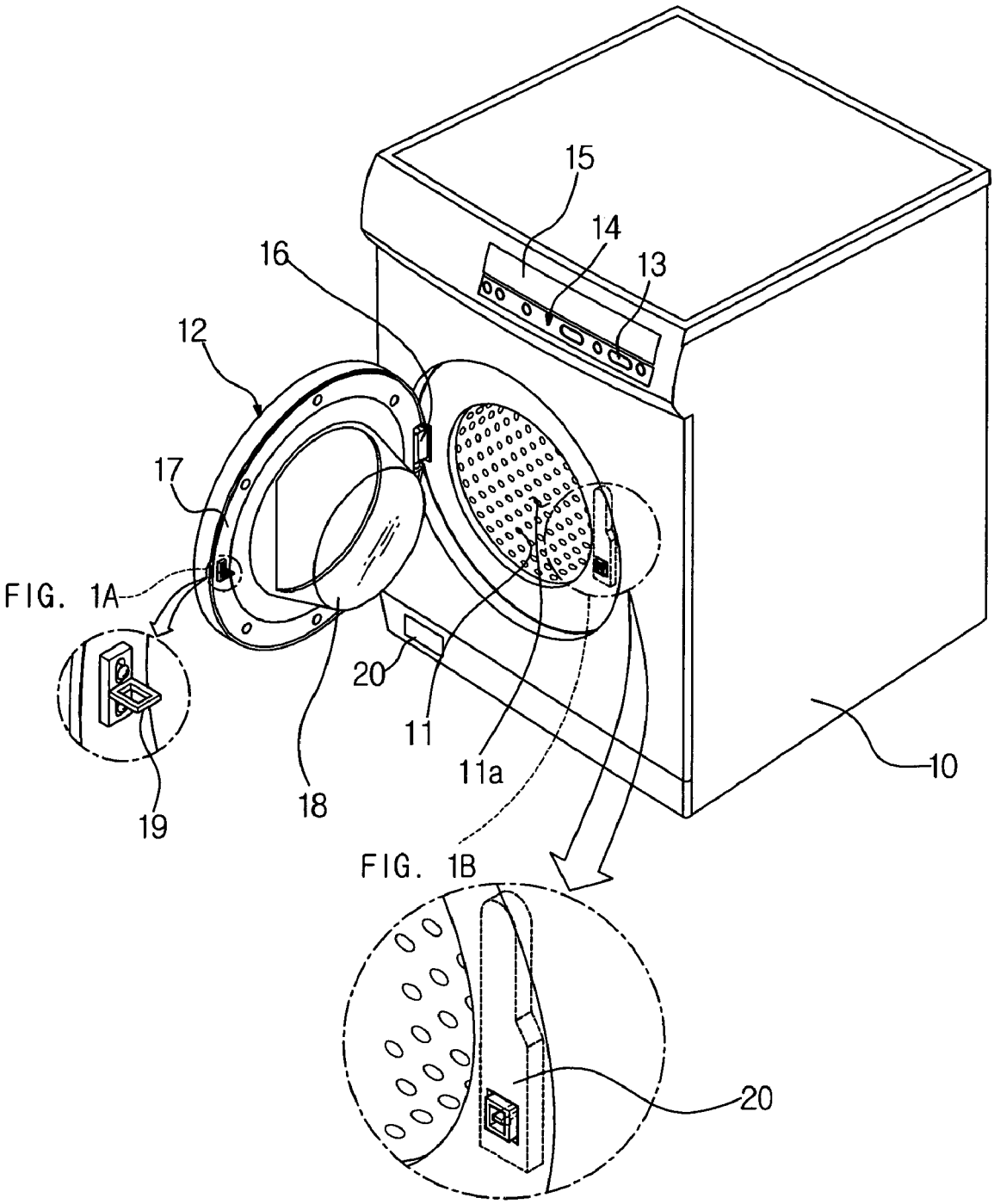
FIG. 1 is a perspective view showing a drum washing machine consistent with the present invention, with FIGS. 1A and 1B being enlarged portions of FIG. 1.

Referring to FIG. 1, a drum washing machine according to the present invention comprises: a hexahedral machine body 10 forming the external appearance of the drum washing machine; a drum-shaped stationary tub (not shown) disposed in the machine body 10 in a suspended state for containing wash water; a rotary tub 11 coaxially disposed in the stationary tub while being spaced a predetermined distance from the stationary tub for performing rotary movement when the rotary tub 11 is supplied with a rotating force from a driving motor (not shown).

At the front part of the machine body 10 is formed a circular opening 11*a* for allowing the laundry to be put into the rotary tub 11 therethrough. The opening 11*a* is opened or closed by a door 12, which is hingedly connected to the front part of the machine body 10. Also, a control panel 14, which comprises a plurality of buttons, such as an operation button 13, and a display panel 15 are disposed on the front part of the machine body 10.

As shown in FIG. 1, the door 12 comprises: a door cover 17 connected to the front part of the machine body 10 by a hinge 16 at one side of the rear surface of the door cover 17; a door window 18 whose edge is attached to the rear surface of the door cover 17, the door window 18 being formed by injection molding of a glass material such that a user can look into the rotary tub 11 while the opening 11*a* is closed; and a locking lever 19 attached to the other side of the rear surface of the door cover 17 while being protruded rearward for maintaining the locked state of the door 12.

To the front part of the machine body 10 is attached a door-locking device 20, corresponding to the locking lever 19, for holding the locking lever 19, when the door 12 is closed, to maintain the locked state of the door 12.

Figure 2:
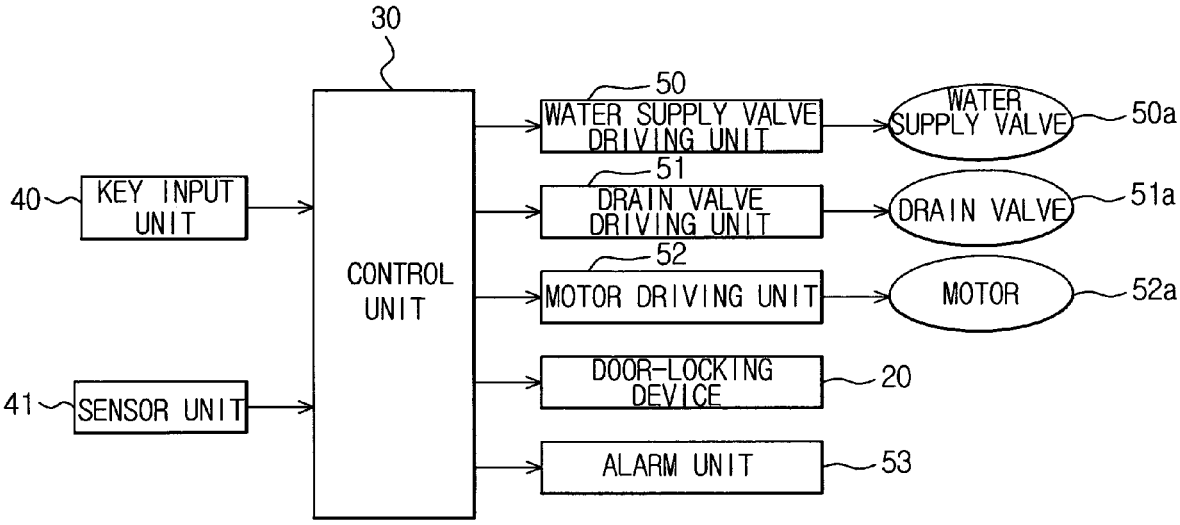
FIG. 2 is a block diagram of the drum washing machine shown in FIG. 1.

As shown in FIG. 2, the drum washing machine according to the present invention further comprises: a control unit 30 for controlling operations of the drum washing machine. To the input side of the control unit 30 are electrically connected a key input unit 40 for a user to input commands and a sensor unit 41 comprising a plurality of sensors, such as a door sensor for sensing the unlocked state of the door and a water level sensor for sensing the level of wash water in the stationary tub.

To the output side of the control unit 30 are electrically connected a water supply valve driving unit 50 for driving a water supply valve 50*a*, a drain valve driving unit 51 for driving a drain valve 51*a*, a motor driving unit 52 for driving a motor 52*a* to rotate the rotary tub 11, and an alarm unit 53 for informing the user that the locked state of the door 12 is released. The door-locking device 20, which serves to maintain the locked state of the door 12, is also electrically connected to the output side of the control unit 30.

The control unit 30 performs a washing or dewatering operation based on a user's command input through the key input unit 40. The control unit 30 locks the door 12 through the door-locking device 20 when a washing or dewatering operation is initiated or when the washing or dewatering operation is resumed after the washing or dewatering operation is interrupted, and releases the locked state of the door 12, during supplying or draining water, for a predetermined period of time after the washing or dewatering operation is performed for another predetermined period of time. After that, the door 12 is locked again. Consequently, the user can safely and conveniently put additional laundry into the rotary tub 11 or remove the laundry or foreign matter from the rotary tub 11 while the locked state of the door 12 is released without interrupting the washing or dewatering operation of the drum washing machine. After the water supply or the water drainage is completed, the control unit 30 rotates the motor 52*a* such that the washing or dewatering operation is resumed.

When the washing or dewatering operation is resumed after the washing or dewatering operation is interrupted, the control unit 30 determines whether the door has been opened during interruption of the washing or dewatering operation. If it is determined that the door has been opened, the control unit 30 releases the lock state of the door 12 through the door-locking device 20 for a predetermined period of time during supplying or draining water. The predetermined period of time is time for which the water level in the rotary tub 11 is kept below a reference water level by supplying or draining water.

A description will be given hereinafter of a process of releasing the locked state of the door 12 for the user to open the door 12 such that the user puts additional laundry into the rotary tub 11 or removes the laundry from the rotary tub 11 during supplying of water when the washing operation of the drum washing machine is initiated.

Figure 3:
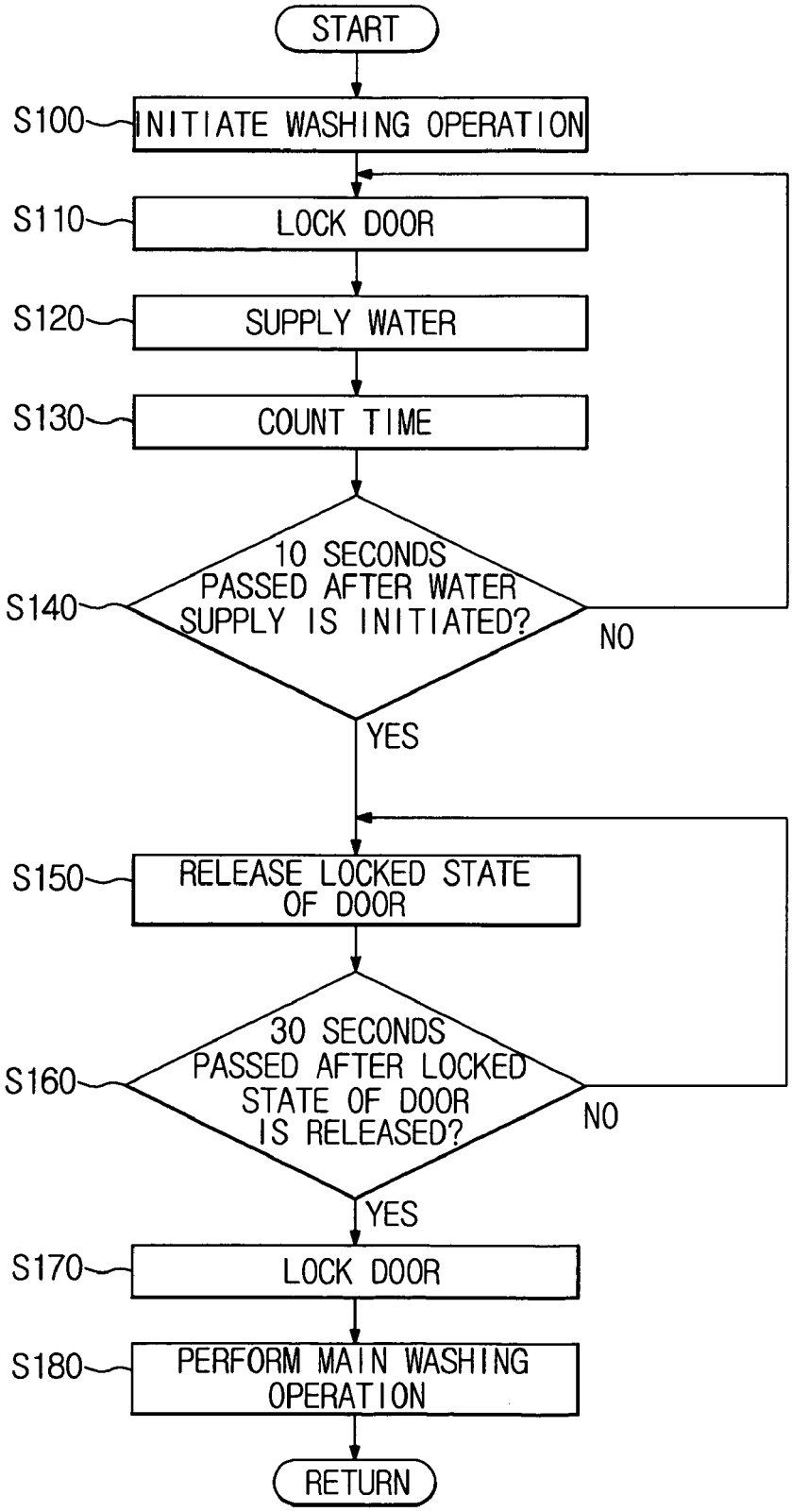
FIG. 3 is a flow chart illustrating a process of releasing the locked state of a door of the drum washing machine shown in FIG. 1 for a user to open the door such that the user puts additional laundry into the drum washing machine or removes the laundry from the drum washing machine during supplying water when a washing operation of the drum washing machine is initiated.

When the user presses a power button and then the washing operation button 13, the washing operation is initiated in Operation S100, as shown in FIG. 3.

The control unit 30 locks the door 12 through the door-locking device 20 in Operation S110 such that the door 12 cannot be opened by the user, and turns on the water supply valve 50*a* through the water supply valve driving unit 50 to supply wash water into the stationary tub in Operation S120.

At this time, the motor 52*a* is not operated. In Operation S130, the control unit 30 counts time after the water supply is initiated.

In Operation S140, the control unit 30 determines whether a predetermined period of door-locking time, for example, 10 seconds, has passed after the water supply is initiated.

If it is determined in Operation S140 that the predetermined period of door-locking time has not passed after the water supply is initiated, Operation S110 is repeated.

If it is determined in Operation S140 that the predetermined period of door-locking time has passed after the water supply is initiated, the control unit 30 releases the locked state of the door 12 through the door-locking device 20 for the user to open the door 12 in Operation S150. Consequently, the user can put additional laundry into the rotary tub 11 or remove the laundry or foreign matter from the rotary tub 11.

In Operation S160, the control unit 30 determines whether a predetermined period of door-unlocking time, for example, 30 seconds, has passed after the locked state of the door 12 is released. At this time, the water supply is not interrupted for the predetermined period of door-unlocking time, i.e., the wash water is continuously supplied.

If it is determined in Operation S160 that the predetermined period of door-unlocking time has not passed after the locked state of the door 12 is released, Operation S150 is repeated.

If it is determined in Operation S160 that the predetermined period of door-unlocking time has passed after the locked state of the door 12 is released, the control unit 30 locks the door 12 again through the door-locking device 20 in Operation S170 such that the door 12 is not opened by the user.

In Operation S180, the control unit 30 completes the water supply, and then operates the motor 52*a* to perform the main washing operation.

In the above-described embodiment, the door 12 is locked immediately after the water supply is initiated in order to prevent the user from being injured by hot wash water when the hot wash water is supplied. When cold wash water is supplied, however, the locked state of the door 12 may be released for a predetermined period of time immediately after the water supply is initiated.

A description will be given hereinafter of a process of releasing the locked state of the door 12 for the user to open the door 12 such that the user may put additional laundry into the rotary tub 11 or remove the laundry from the rotary tub 11 during the draining of water when the dewatering operation of the drum washing machine is initiated.

Figure 4:
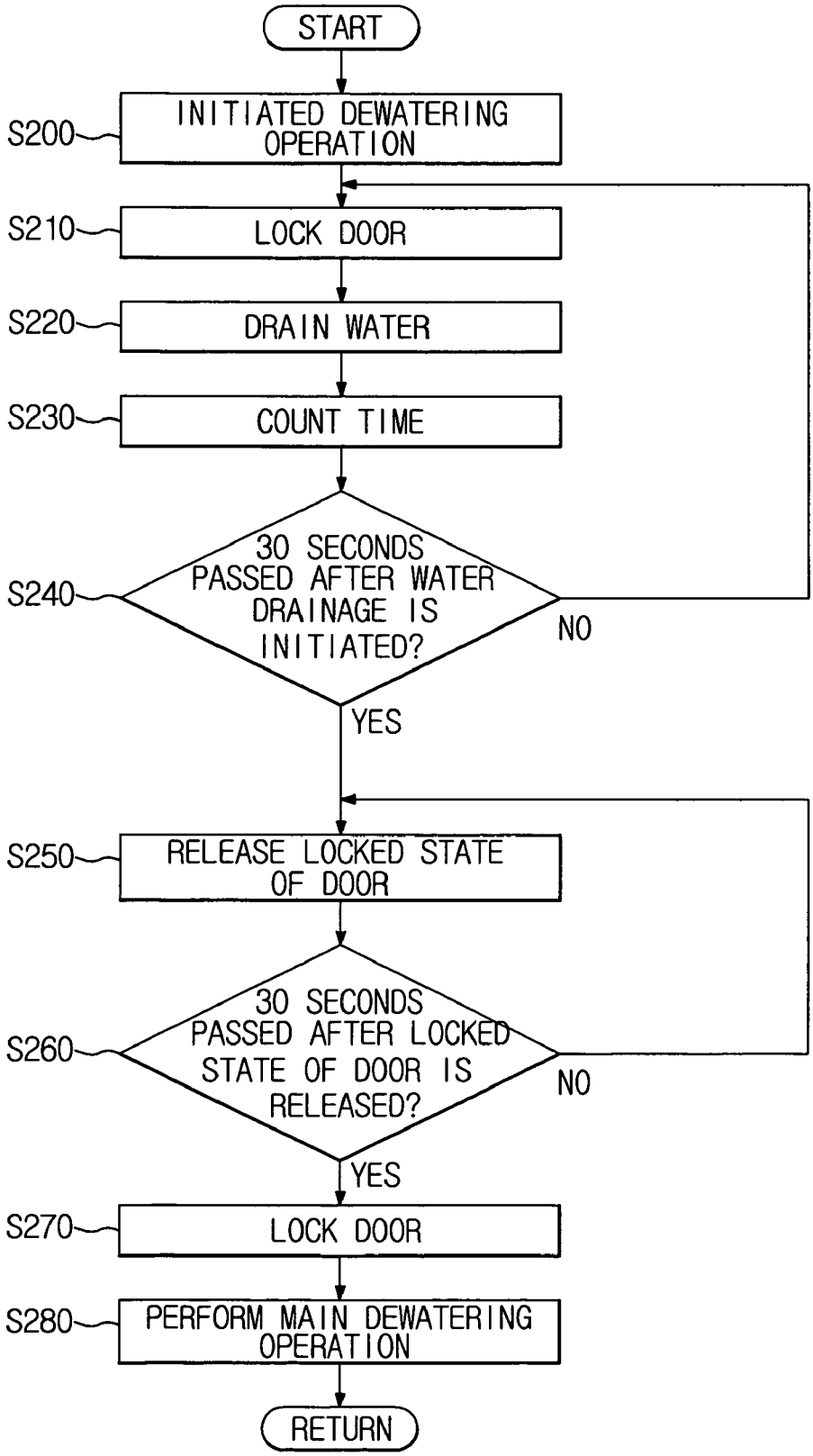
FIG. 4 is a flow chart illustrating a process of releasing the locked state of the door of the drum washing machine shown in FIG. 1 for the user to open the door such that the user puts additional laundry into the drum washing machine or removes the laundry from the drum washing machine during draining water when a dewatering operation of the drum washing machine is initiated.

When the user presses a dewatering operation button or conditions for the dewatering operation are satisfied, the dewatering operation is initiated in Operation S200, as shown in FIG. 4.

At this time, the wash water is contained in the rotary tub 11. Consequently, the control unit 30 locks the door 12 through the door-locking device 20 in Operation S210 such that the door 12 cannot be opened by the user, and therefore, the wash water is prevented from flowing out of the drum washing machine through the opening 11*a*, and turns on the drain valve 51*a* through the drain valve driving unit 51 to drain wash water out of the rotary tub 11 in Operation S220 such that the wash water in the rotary tub 11 does not flow out of the drum washing machine through the opening 11*a* when the door 12 is opened. At this time, the motor 52*a* is not operated. In Operation S230, the control unit 30 counts time after the water drainage is initiated.

In Operation S240, the control unit 30 determines whether a predetermined period of door-locking time, for example, 30 seconds, has passed after the water drainage is initiated. The predetermined period of door-locking time is the time necessary to lower the water level in the rotary tub 11 such that the wash water in the rotary tub 11 does not flow out of the drum washing machine through the opening 11*a* when the door 12 is opened.

If it is determined in Operation S240 that the predetermined period of door-locking time has not passed after the water drainage is initiated, Operation S210 is repeated.

If it is determined in Operation S240 that the predetermined period of door-locking time has passed after the water drainage is initiated, the control unit 30 releases the locked state of the door 12 through the door-locking device 20 for the user to open the door 12 in Operation S250. Consequently, the user can put additional laundry into the rotary tub 11 or remove the laundry or foreign matter from the rotary tub 11.

In Operation S260, the control unit 30 determines whether a predetermined period of door-unlocking time, for example, 30 seconds, has passed after the locked state of the door 12 is released. At this time, the water drainage is not interrupted for the predetermined period of door-unlocking time, i.e., the wash water is continuously drained.

If it is determined in Operation S260 that the predetermined period of door-unlocking time has not passed after the locked state of the door 12 is released, Operation S250 is repeated.

If it is determined in Operation S260 that the predetermined period of door-unlocking time has passed after the locked state of the door 12 is released, the control unit 30 locks the door 12 again through the door-locking device 20 in Operation S270 such that the door 12 cannot be opened by the user.

In Operation S280, the control unit 30 completes the water drainage, and then operates the motor 52*a* to perform the main dewatering operation.

A description will be given hereinafter of a process of releasing the locked state of the door 12 for a predetermined period of time during supplying water when the washing operation of the drum washing machine is resumed after the washing operation of the drum washing machine is interrupted.

Figure 5:
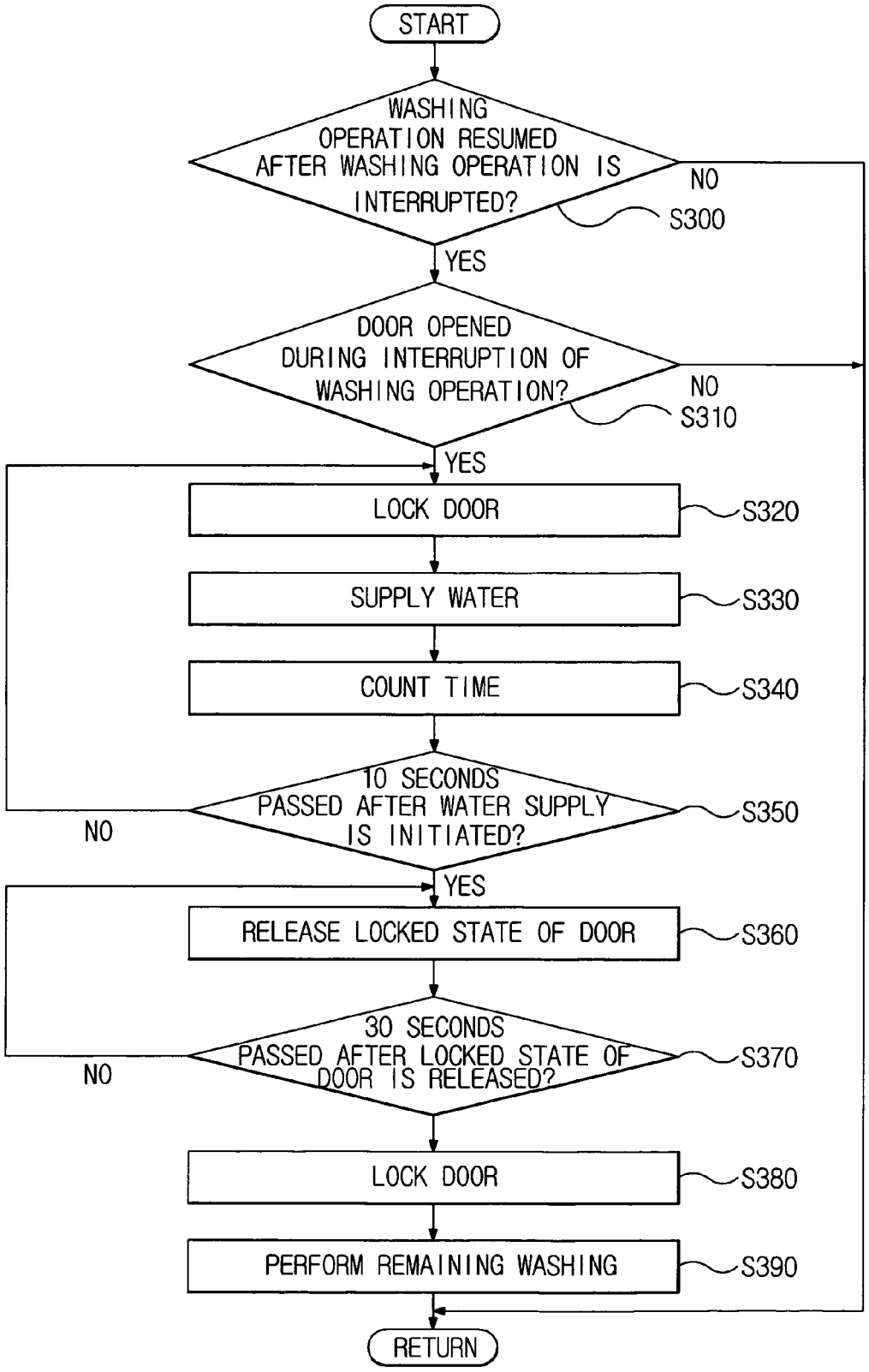
FIG. 5 is a flow chart illustrating a process of releasing the locked state of the door of the drum washing machine shown in FIG. 1 for the user to open the door such that the user puts additional laundry into the drum washing machine or removes the laundry from the drum washing machine during supplying water when the washing operation of the drum washing machine is resumed after the washing operation of the drum washing machine is interrupted.

The control unit 30 determines whether the washing operation is resumed after the washing operation is interrupted in Operation S300, as shown in FIG. 5. If it is determined that the washing operation is resumed after the washing operation is interrupted, the control unit 30 determines whether the door 12 has been opened during interruption of the washing operation in Operation S310.

If it is determined in Operation S310 that the door 12 has been opened during interruption of the washing operation, the control unit 30 locks the door 12 through the door-locking device 20 in Operation S320 such that the door 12 cannot be opened by the user, and turns on the water supply valve 50*a* through the water supply valve driving unit 50 to supply wash water into the stationary tub in Operation S330. At this time, the motor 52*a* is not operated. In Operation S340, the control unit 30 counts time after the water supply is initiated.

In Operation S350, the control unit 30 determines whether a predetermined period of door-locking time, for example, 10 seconds, has passed after the water supply is initiated.

If it is determined in Operation S350 that the predetermined period of door-locking time has not passed after the water supply is initiated, Operation S320 is repeated.

If it is determined in Operation S350 that the predetermined period of door-locking time has passed after the water supply is initiated, the control unit 30 releases the locked state of the door 12 through the door-locking device 20 for the user to open the door 12 in Operation S360. Consequently, the user can put additional laundry into the rotary tub 11 or remove the laundry or foreign matter from the rotary tub 11.

In Operation S370, the control unit 30 determines whether a predetermined period of door-unlocking time, for example, 30 seconds, has passed after the locked state of the door 12 is released. At this time, the water supply is not interrupted for the predetermined period of door-unlocking time, i.e., the wash water is continuously supplied.

If it is determined in Operation S370 that the predetermined period of door-unlocking time has not passed after the locked state of the door 12 is released, Operation S360 is repeated.

If it is determined in Operation S370 that the predetermined period of door-unlocking time has passed after the locked state of the door 12 is released, the control unit 30 locks the door 12 again through the door-locking device 20 in Operation S380 such that the door 12 is not opened by the user.

In Operation S390, the control unit 30 completes the water supply, and then performs the remaining washing operation.

A description will be given hereinafter of a process of releasing the locked state of the door 12 for a predetermined period of time during draining water when the dewatering operation of the drum washing machine is resumed after the dewatering operation of the drum washing machine is interrupted.

Figure 6:
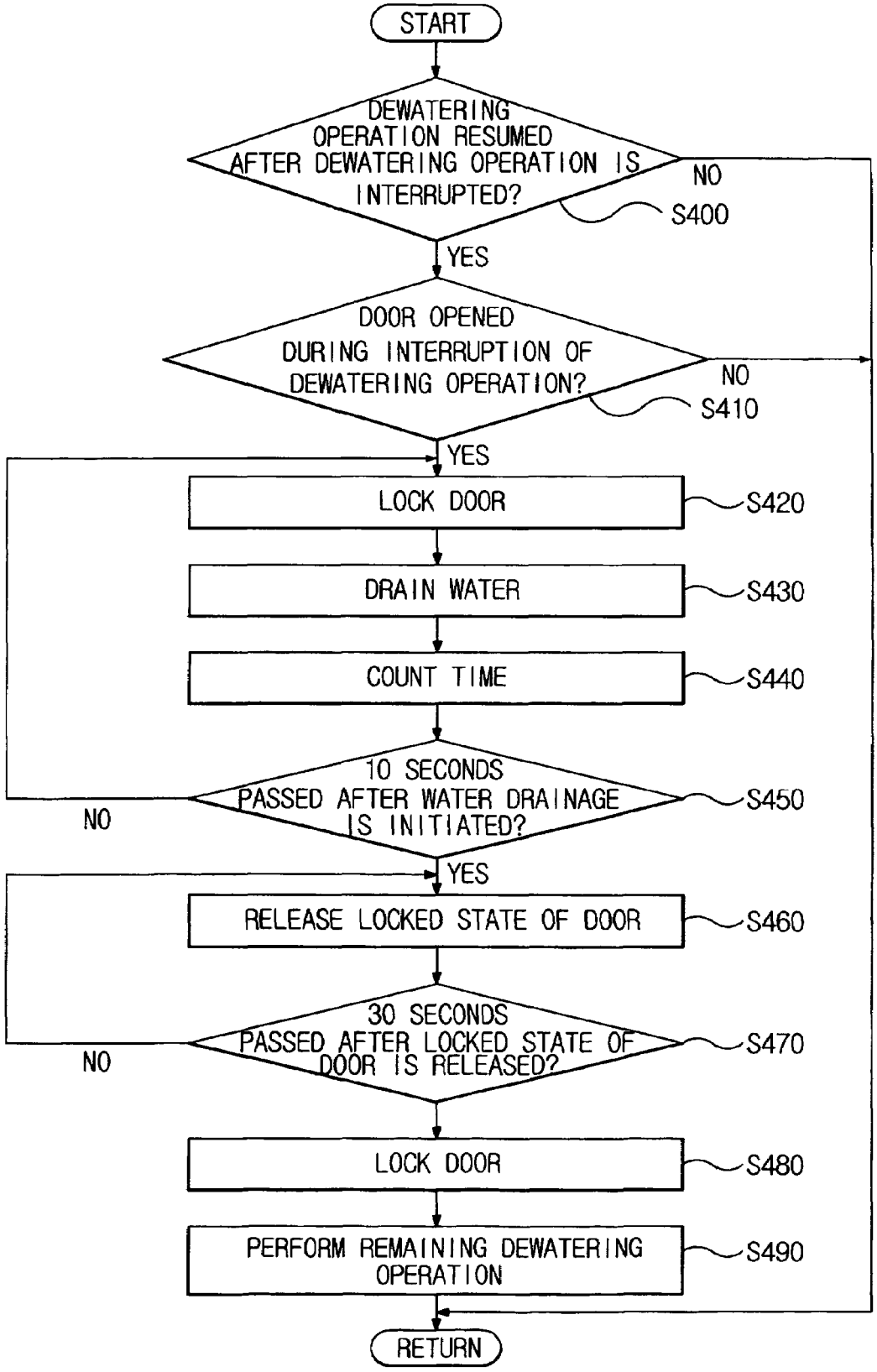
FIG. 6 is a flow chart illustrating a process of releasing the locked state of the door of the drum washing machine shown in FIG. 1 for the user to open the door such that the user puts additional laundry into the drum washing machine or removes the laundry from the drum washing machine during the draining of water when the dewatering operation of the drum washing machine is resumed after the dewatering operation of the drum washing machine is interrupted.

The control unit 30 determines whether the dewatering operation is resumed after the dewatering operation is interrupted in Operation S400, as shown in FIG. 6. If it is determined that the dewatering operation is resumed after the dewatering operation is interrupted, the control unit 30 determines whether the door 12 has been opened during interruption of the dewatering operation in Operation S410.

If it is determined in Operation S410 that the door 12 has been opened during interruption of the dewatering operation, the control unit 30 locks the door 12 through the door-locking device 20 in Operation S420 such that the door 12 cannot be opened by the user, and therefore, the wash water is prevented from flowing out of the drum washing machine through the opening 11*a*, and turns on the drain valve 51*a* through the drain valve driving unit 51 to drain wash water out of the rotary tub 11 in Operation S430 such that the wash water in the rotary tub 11 does not flow out of the drum washing machine through the opening 11*a* when the door 12 is opened. At this time, the motor 52*a* is not operated. In Operation S440, the control unit 30 counts time after the water drainage is initiated.

In Operation S450, the control unit 30 determines whether a predetermined period of door-locking time, for example, 10 seconds, has passed after the water drainage is initiated. The predetermined period of door-locking time is the time necessary to lower the water level in the rotary tub 11 such that the wash water in the rotary tub 11 does not flow out of the drum washing machine through the opening 11*a* when the door 12 is opened.

If it is determined in Operation S450 that the predetermined period of door-locking time has not passed after the water drainage is initiated, Operation S420 is repeated.

If it is determined in Operation S450 that the predetermined period of door-locking time has passed after the water drainage is initiated, the control unit 30 releases the locked state of the door 12 through the door-locking device 20 for the user to open the door 12 in Operation S460. Consequently, the user can put additional laundry into the rotary tub 11 or remove the laundry or foreign matter from the rotary tub 11.

In Operation S470, the control unit 30 determines whether a predetermined period of door-unlocking time, for example, 30 seconds, has passed after the locked state of the door 12 is released. At this time, the water drainage is not interrupted for the predetermined period of door-unlocking time, i.e., the wash water is continuously drained.

If it is determined in Operation S470 that the predetermined period of door-unlocking time has not passed after the locked state of the door 12 is released, Operation S460 is repeated.

If it is determined in Operation S470 that the predetermined period of door-unlocking time has passed after the locked state of the door 12 is released, the control unit 30 locks the door 12 again through the door-locking device 20 in Operation S480 such that the door 12 cannot be opened by the user.

In Operation S490, the control unit 30 performs the remaining dewatering operation.

As apparent from the above description, the locked state of the door is released for a predetermined period of time without interrupting the water supply or the water drainage for the user to open the door, during supplying or draining water, when the washing or dewatering operation of the drum washing machine is initiated or when the washing or dewatering operation of the drum washing machine is resumed after the washing or dewatering operation of the drum washing machine is interrupted. Consequently, the present invention has the effect of allowing the user safely and conveniently to put additional laundry into the rotary tub or remove the laundry or foreign matter from the rotary tub with improved washing and dewatering efficiency.

Although an exemplary embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A method of controlling a drum washing machine with a door, the method comprising:

locking the door for a second predetermined period of time when one of a washing and dewatering operation is initiated; and when the washing or dewatering operation is resumed after the washing or dewatering operation is interrupted;

releasing a locked state of the door for a first predetermined period of time after the second predetermined period of time elapses; and locking the door again after the first predetermined period of time elapses.

2. The method according to claim 1, wherein the locked state of the door is released after water is supplied or drained for the second predetermined period of time.

3. The method according to claim 2, wherein the first predetermined period of time is a time for which a water level in a rotary tub is kept below a reference water level by supplying or draining water.

4. The method according to claim 1, wherein the locked state of the door is released if it is sensed that the door has been opened during interruption of the washing or dewatering operation when the washing or dewatering operation is resumed after the washing or dewatering operation is interrupted.

5. The method according to claim 1, further comprising: informing a user that the locked state of the door is released.

* * * * *